US011034185B2

(12) United States Patent
Lin

(10) Patent No.: US 11,034,185 B2
(45) Date of Patent: Jun. 15, 2021

(54) PENCIL SHARPENER ASSEMBLY

(71) Applicant: Xiasen Lin, Taizhou (CN)

(72) Inventor: Xiasen Lin, Taizhou (CN)

(73) Assignee: SUNWOOD HOLDING GROUP CO., LTD., Taizhou (CN)

( * ) Notice: Subject to any disclaimer, the term of this patent is extended or adjusted under 35 U.S.C. 154(b) by 22 days.

(21) Appl. No.: 16/199,320

(22) Filed: Nov. 26, 2018

(65) Prior Publication Data

US 2019/0308443 A1 Oct. 10, 2019

(30) Foreign Application Priority Data

Apr. 4, 2018 (CN) ..... 201810300814.5

(51) Int. Cl.
*B43L 23/08* (2006.01)
*B43L 23/00* (2006.01)
*B26D 1/00* (2006.01)

(52) U.S. Cl.
CPC ..... *B43L 23/08* (2013.01); *B43L 23/004* (2013.01); *B43L 23/008* (2013.01); *B26D 2001/002* (2013.01)

(58) Field of Classification Search
CPC ..... B43L 23/08; B43L 23/06; B43L 23/02; B43L 34/00; B43L 34/008; A45D 2040/202
USPC ..... 30/451–462
See application file for complete search history.

(56) References Cited

U.S. PATENT DOCUMENTS 3,221,709 A * 12/1965 Racaj Montemayor ..... B43L 23/08 30/457
5,379,817 A 1/1995 O'Neil et al.
6,092,293 A * 7/2000 Donaldson ..... B43L 23/08 30/457
6,279,237 B1 8/2001 Luttgens
6,397,479 B1 * 6/2002 Luttgens ..... B43L 23/08 144/28.11
6,397,480 B1 6/2002 Mak et al.
(Continued)

FOREIGN PATENT DOCUMENTS

CN 100384643 C 4/2008
CN 201261340 Y 6/2009
(Continued)

*Primary Examiner* — Ghassem Alie
*Assistant Examiner* — Fernando A Ayala
(74) *Attorney, Agent, or Firm* — Minder Law Group; Willy H. Wong

(57) ABSTRACT

A pencil sharpener assembly comprising a frame and a blade, the blade having an elongated sheet shape, one side of the blade being disposed with a blade edge, the frame being disposed with a pencil chamber, the blade being disposed along an axial direction of the pencil chamber and the blade edge of the blade being located in the pencil chamber, the blade being made of a ceramic material, the frame being disposed with a first positioning groove and a second positioning groove, the first positioning groove and the second positioning groove being oppositely disposed, a first end of the blade being inserted into the first positioning groove, and a second end of the blade being inserted into the second positioning groove. It has the advantages of being applicable to ceramic-made blades and the blade is not easy to fracture.

9 Claims, 12 Drawing Sheets

(56) References Cited

U.S. PATENT DOCUMENTS

| | | | | |
|---|---|---|---|---|
| 6,571,480 | B1 * | 6/2003 | Qiu | B43L 23/08 30/451 |
| 7,523,557 | B2 * | 4/2009 | Smith | B43L 23/08 30/451 |
| 8,656,600 | B2 * | 2/2014 | Hammer | B43L 23/08 30/451 |
| 2004/0261275 | A1 * | 12/2004 | Fregeolle | B43K 23/001 30/457 |
| 2005/0005459 | A1 * | 1/2005 | Donaldson | B43L 23/08 30/457 |
| 2005/0138819 | A1 * | 6/2005 | Co | B43L 23/08 30/457 |
| 2005/0257387 | A1 * | 11/2005 | Luttgens | B43L 23/08 30/456 |
| 2011/0258863 | A1 * | 10/2011 | Hammer | B43L 23/008 30/457 |
| 2012/0017451 | A1 * | 1/2012 | Luettgens | B43L 23/08 30/457 |
| 2012/0192995 | A1 * | 8/2012 | Chen | B43L 23/08 144/28.8 |
| 2013/0174429 | A1 * | 7/2013 | Constantine | B43L 23/008 30/454 |
| 2014/0075681 | A1 * | 3/2014 | Hammer | B25F 1/00 7/151 |
| 2015/0082956 | A1 | 3/2015 | Lou | |
| 2016/0068009 | A1 * | 3/2016 | Chen | B43L 23/008 144/28.11 |

FOREIGN PATENT DOCUMENTS

| | | | |
|---|---|---|---|
| CN | 202498920 | U | 10/2012 |
| CN | 202593115 | U | 12/2012 |
| CN | 203543468 | U | 4/2014 |
| CN | 204055040 | U | 12/2014 |
| CN | 104972808 | A | 10/2015 |
| CN | 204749668 | U | 11/2015 |
| CN | 205416906 | U | 8/2016 |
| CN | 206884547 | U | 1/2018 |
| CN | 104960144 | B | 2/2018 |
| TW | 200810947 | A | 3/2008 |

* cited by examiner

D-D

E-E

PENCIL SHARPENER ASSEMBLY

RELATED APPLICATIONS

This application claims priority to China Patent Application No. CN201810300814.5 filed Apr. 4, 2018.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention belongs to the technical field of machinery and relates to a pencil sharpener assembly.

Related Art

Pencil sharpener is a tool for sharpening pencils, it is widely used for daily study or work because it is convenient to use. In order to improve its convenience, many types of electric pencil sharpeners have been introduced into the market, without the need for manual operation, simply insert a pencil and press the button to start sharpening the pencil automatically. Whether it is an ordinary manual pencil sharpener or an electric pencil sharpener, the pencil sharpener assembly and the blade are the foundation, and the blade is connected on the pencil sharpener assembly. If it is a manual pencil sharpener, pencil sharpening is generally performed by inserting the pencil into the pencil sharpener assembly, and then manually rotating the pencil sharpener assembly or the pencil, the pencil can be sharpened as long as there is a relative rotation between the pencil and the blade. If it is an electric pencil sharpener, a housing is generally disposed as an exterior, a motor is fixed in the housing and the pencil sharpener assembly is also disposed in the housing. The pencil sharpener assembly is fixed to the end of a rotating shaft of the motor so that when the pencil is inserted into the pencil sharpener assembly, the end of the pencil is automatically sharpened by the rotation of the pencil sharpener assembly driven by the rotating shaft of the motor.

In the prior art, for example, the pencil sharpener assembly is generally formed by injection molding and the blade is made of a metal material, the pencil sharpener assembly has a screw hole after molding, and the blade is disposed with a connecting through hole, and the conventional connection of the blade and the pencil sharpener assembly during assembly is performed by inserting a screw through the connecting through hole of the blade and connecting with a screw thread of the screw hole to fix the blade on the pencil sharpener assembly. However, the blade made of metal material will easily cause the core of the pencil to break during the sharpening process, and after the blade made of metal material has been used for a long period of time, the sharpening capability is reduced due to the blunt blade edge, and the blade needs to be replaced.

In this case, the ceramic-made blade is actually a very good choice. Compared with metal blades, ceramic-made blades are more wear-resistant, the service life is much longer than ordinary metal blades, and it is not easy to cause the pencil core to break. However, because the blade is required to have a sheet-like structure in the field of pencil sharpener, and the ceramic-made blade has a problem of becoming more brittle when it is made into a sheet shape. If the conventional method of fixing the blade by tightly screwing with a screw or a bolt is adopted, it can easily break the ceramic-made blade to cause the ceramic-made blade to be unusable in the pencil sharpener.

SUMMARY OF THE INVENTION

In view of the above-mentioned problems in the prior art, one object of one embodiment of the present invention is to provide a pencil sharpener assembly to solve the technical problems of how to apply a ceramic-made blade in a pencil sharpener and prevent the ceramic-made blade from being fractured easily.

One object of one embodiment of the present invention can be achieved by the following technical solutions:

One embodiment of a pencil sharpener assembly comprising a frame and a blade, the blade having an elongated sheet shape, one side of the blade being disposed with a blade edge, the frame being disposed with a pencil chamber, the blade being disposed along an axial direction of the pencil chamber and the blade edge of the blade being located in the pencil chamber, the blade being made of a ceramic material, the frame being disposed with a first positioning groove and a second positioning groove, the first positioning groove and the second positioning groove being oppositely disposed, a first end of the blade being inserted into the first positioning groove, and a second end of the blade being inserted into the second positioning groove.

By disposing the blade along the axial direction of the pencil chamber and placing the blade edge of the blade in the pencil chamber, it can be ensured that the ceramic-made blade can sharpen a pencil placed in the pencil chamber. Then, provided that the pencil can be sharpened normally, the pencil sharpener assembly is further disposed with the first positioning groove and the second positioning groove on the frame, and the first end of the blade is inserted into the first positioning groove, and the second end of the blade is inserted into the second positioning groove, thereby the ceramic-made blade can be fixed on the frame of the pencil sharpener assembly to realize the use of the pencil sharpener assembly in the field of pencil sharpener. Moreover, the first end of the ceramic-made blade is fixed by the first positioning groove, and the second end of the ceramic-made blade is fixed by the second positioning groove, so that it is not required to process on the ceramic-made blade, thereby preventing the ceramic-made blade from fracturing when it is being fixed.

In order to form the first positioning groove and the second positioning groove on the frame, the pencil sharpener assembly can alternatively have the ceramic-made blade directly integrated into the frame when forming the frame, and specifically, the blade can be placed in a mold of the frame with a cavity having a same shape as the frame, and then inject into the mold of the frame for molding. In this way, after the frame is formed in the mold of the frame, the first positioning groove and the second positioning groove are formed on the frame, and the first end of the blade is naturally located in the first positioning groove, and the second end of the blade is naturally located in the second positioning groove, thereby enabling the ceramic-made blade to be fixed on the frame to realize the use of the ceramic-made blade in the field of pencil sharpener.

In one embodiment of the above-mentioned pencil sharpener assembly, the frame comprises an upper plate, a lower plate disposed oppositely to the upper plate, as well as a first support plate and a second support plate with both the first support plate and the second support plate being connected between the upper plate and the lower plate, a lower end surface of the upper plate is disposed with a pencil holder, the pencil chamber is disposed on the pencil holder, an upper end surface of the lower plate is disposed with a positioning portion and the positioning portion is located below the pencil holder, and the first positioning groove is disposed on an upper end surface of the positioning portion.

Under normal circumstances, the pencil holder hangs above an empty space below, so that the pencil can feed downwardly after the pencil tip is sharpened, and a portion of the pencil above the pen tip can also be sharpened. Therefore, by having the frame of the pencil sharpener assembly disposed with the upper plate, the lower plate disposed oppositely to the upper plate, as well as the first support plate and the second support plate connected between the upper plate and the lower plate, an interior of the entire frame is formed with a larger space. Then after the pencil holder is disposed on the lower end surface of the upper plate, by having the upper end surface of the lower plate disposed with the positioning portion located below the pencil holder, and by having the first positioning groove disposed on the upper end surface of the positioning portion, the first end of the ceramic-made blade can be positioned, thereby the ceramic-made blade can be fixed on the frame to realize the use of the ceramic-made blade in the field of pencil sharpener and to prevent fracturing of the blade when it is being fixed.

In one embodiment of the above-mentioned pencil sharpener assembly, a side portion of the pencil holder is penetratingly disposed with a blade inlet communicated with the pencil chamber, a support panel is fixedly connected between an inner side wall of the first support plate and an outer side wall of the pencil holder, a lower end surface of the support panel is fixedly connected to the upper end surface of the positioning portion, the blade is attached on the support panel and a surface of the support panel that mates with the blade is flush with a second side wall of the pencil holder at the blade inlet, and the blade edge of the blade passes through the blade inlet and extends into the pencil chamber.

The support panel is fixedly connected between the inner side wall of the first support plate and the outer side wall of the pencil holder, the lower end surface of the support panel is fixedly connected to the upper end surface of the positioning portion, while the two ends of the blade are fixed by the first positioning groove and the second positioning groove, the blade is attached on the support panel to form a support; the support panel can integrally connect the structure of the frame at the first positioning groove with the structure of the frame at the second positioning groove, so that the structure on the frame for fixing the blade is more stable, in other words, the stability of the ceramic-made blade after being fixed on the frame is enhanced. By disposing the surface of the support panel that mates with the blade to flush with the second side wall of the pencil holder at the blade inlet, it can ensure that after the blade is attached on the support panel, the blade edge of the blade is precisely able to extend into the pencil chamber through the blade inlet so that the ceramic-made blade can sharpen the pencil that penetrates into the pencil chamber.

In one embodiment of the above-mentioned pencil sharpener assembly, a lower portion of the surface of the support panel that mates with the blade is disposed with a first positioning block, a lower end surface of the first positioning block is fixedly connected to the upper end surface of the positioning portion, a first side wall of the first positioning block is fixedly connected to the inner side wall of the first support plate, and a second side wall of the first positioning block abuts against a blade spine opposite the blade edge.

The blade as a whole will be subjected to a backward reacting force when sharpening the pencil. Therefore, although the two ends of the blade are fixed on the frame by the first positioning groove and the second positioning groove, the portion of the blade other than the two ends is more brittle. Therefore, by having the lower portion of the surface of the support panel that mates with the blade disposed with the first positioning block, the first side wall of the first positioning block fixedly connected to the inner side wall of the first support plate, and the second side wall of the first positioning block abutted against the blade spine opposite the blade edge; a good supporting force can be formed, so that the ceramic-made blade can be well fixed during use, and can further prevent the blade from fracturing when it is being fixed or used.

In one embodiment of the above-mentioned pencil sharpener assembly, the pencil holder has an inverted tapered shape, an outer side of an upper end of the pencil holder is disposed with an outer bulge along an outer peripheral surface of the pencil holder, the outer bulge has an arcuate shape, a first end of the outer bulge is disposed with an extension extended outward away from the pencil holder, an upper end surface of the support panel is fixedly connected to the lower end surface of the upper plate, and an upper portion of the surface of the support panel that mates with the blade as well as an inner side surface of the extension form the second positioning groove.

The ceramic-made blade is attached on the support panel, then by having the outer side of the upper end of the pencil holder disposed with the arcuate shaped outer bulge, and the first end of the outer bulge disposed with the extension extended outward away from the pencil holder; the second positioning groove can be formed between the upper portion of the surface of the support panel that mates with the blade and the inner side surface of the extension to fix the second end of the ceramic-made blade, and, furthermore, the first end of the ceramic-made blade is fixed with the first positioning groove, so that the ceramic-made blade can be fixed with the frame of the pencil sharpener assembly to realize the use of the ceramic-made blade in the field of pencil sharpener and prevent the blade from fracturing.

In one embodiment of the above-mentioned pencil sharpener assembly, a bolster panel is fixedly connected between the outer side wall of the pencil holder and an inner side wall of the second support plate, an upper end surface of the bolster panel is fixedly connected to the lower end surface of the upper plate, and a second end of the outer bulge is fixedly connected to the bolster panel.

By having the bolster panel fixedly connected between the outer side wall of the pencil holder and the inner side wall of the second support plate, the upper end surface of the bolster panel fixedly connected to the lower end surface of the upper plate, and the second end of the outer bulge fixedly connected to the bolster panel, the strength of the outer bulge can be enhanced. Particularly, in the case where the second positioning groove is formed between the inner side surface of the extension and the support panel, since the blade is counteracted when sharpening the pencil and the reacting force is applied to the inner walls of the second positioning groove, the strength of the frame at the second positioning groove can be enhanced by increasing the strength of the outer bulge, thereby ensuring that the ceramic-made blade can be fixed on the frame by using the second positioning groove and the first positioning groove to realize the use of the ceramic-made blade in the field of pencil sharpener.

In one embodiment of the above-mentioned pencil sharpener assembly, the upper portion of the surface of the support panel that mates with the blade is disposed with a second positioning block, an upper end surface of the second positioning block is fixedly connected to a lower end surface of the outer bulge, and a first side wall of the second positioning block abuts against the blade spine opposite the blade edge.

The function of disposing the second positioning block is the same as that of the disposition of the first positioning block, which is to support the blade spine opposite the blade edge to prevent the ceramic-made blade from the hidden danger of fracturing during sharpening due to a high degree of brittleness, and to ensure that the ceramic-made blade can be well fixed during use. Moreover, by the collaborative effect of the first positioning block and the second positioning block, the fixing effect of the ceramic-made blade is better, and the fracturing of the ceramic-made blade during use is further prevented.

In one embodiment of the above-mentioned pencil sharpener assembly, a shape of the first positioning groove and a shape of the second positioning groove are the same as a cross section of the blade, each of inner walls of the first positioning groove mates with each of outer walls of a corresponding end of the blade, and each of inner walls of the second positioning groove mates with each of the outer walls of the corresponding end of the blade.

By having the shape of the first positioning groove and the shape of the second positioning groove the same as the cross section of the blade, when the first end of the blade is inserted into the first positioning groove, each of the inner walls of the first positioning groove mates with each of the outer walls of the corresponding end of the blade; when the second end of the blade is inserted into the second positioning groove, each of the inner walls of the second positioning groove mates with each of the outer walls of the corresponding end of the blade. In this way, there is no gap between the blade and the first positioning groove as well as the blade and the second positioning groove, which further improves the fixing effect of the ceramic-made blade on the frame, and prevents the fracturing of the ceramic-made blade.

In one embodiment of the above-mentioned pencil sharpener assembly, the second positioning groove communicates with the blade inlet.

Since the pencil sharpener assembly uses the first positioning groove and the second positioning grooves to fix the ceramic-made blade, and the blade edge of the blade is required to be located in the pencil chamber, then having the second positioning groove communicating with the blade inlet precisely allows the blade edge of the blade to be capable of passing through the blade inlet and extending into the pencil chamber while the ceramic-made blade is fixed by the first positioning groove and the second positioning groove on the frame.

In one embodiment of the above-mentioned pencil sharpener assembly, the blade is disposed with a bevel adjacent to the blade edge, an inner side of the outer bulge is correspondingly disposed with an inclined second locking surface, the positioning portion is correspondingly disposed with an inclined first locking surface on an inner side of the first positioning groove, the first locking surface is attached to a lower portion of the bevel, and the second locking surface is attached to an upper portion of the bevel.

The blade edge of the blade in the conventional design is also required to pass through the blade inlet and extend into the pencil chamber; however, since the ordinary blade can be directly fixed by screws, the case in which the blade edge of the blade extends excessively into the pencil chamber will not occur. However, since the pencil sharpener assembly in the present application adopts the ceramic-made blade and uses the first positioning groove and the second positioning groove to position the both ends of the ceramic-made blade, it is impossible to control an extent to which the blade edge of the blade extends into the pencil chamber. In order to solve this problem, by having the blade disposed with the bevel adjacent to the blade edge, the inner side of the outer bulge correspondingly disposed with the inclined second locking surface, the positioning portion correspondingly disposed with the inclined first locking surface on the inner side of the first positioning groove, and by having the first locking surface attached to the lower portion of the bevel, and the second locking surface attached to the upper portion of the bevel, so that the extent to which the blade edge of the blade extends into the pencil chamber is limited, thereby the extent to which the blade edge of the blade extends into the pencil chamber can be well ensured after the ceramic-made blade is fixed on the frame, and the fixing effect of the ceramic-made blade on the frame can be further enhanced.

In one embodiment of the above-mentioned pencil sharpener assembly, a bolster strip is disposed between an outer side wall of the outer bulge and an outer side wall of the positioning portion, and an inner side surface of the bolster strip is attached to an outer side surface of the blade.

By having the bolster strip disposed between the outer side wall of the outer bulge and the outer side wall of the positioning portion, and the inner side surface of the bolster strip attached to the outer side surface of the blade, the fixing effect of the ceramic-made blade on the frame can be further enhanced.

Compared with the prior art, one embodiment of the pencil sharpener assembly is disposed with the first positioning groove and the second positioning groove on the frame, and the first end of the ceramic-made blade is inserted into the first positioning groove, and the second end of the blade is inserted into the second positioning groove, thereby the ceramic-made blade can be fixed on the frame to realize the use of the ceramic-made blade in the field of pencil sharpener. Furthermore, since it is not required to process on the ceramic-made blade for fixing, thereby preventing the ceramic-made blade from fracturing when it is being fixed. Moreover, the positioning of the blade by using the structure can eliminate the traditional screwing process, enhance the work efficiency, and avoid the failure rate caused by the screw being too loose or too tight.

In addition, one embodiment of the pencil sharpener assembly further enhances the firmness of the blade after being fixed on the frame by the dispositions of the support panel, the first positioning block and the second positioning block, so that the fixing effect of the ceramic-made blade is better; by having the locking surfaces attached on the bevel, the extent to which the blade edge of the blade extends into the pencil chamber is limited, thereby the extent to which the blade edge of the blade extends into the pencil chamber can be well ensured after the ceramic-made blade is fixed on the frame, and the fixing effect can be further enhanced.

DETAILED DESCRIPTION OF THE INVENTION

The technical solutions of the present invention are further described below with reference to the specific embodiments of the present invention in conjunction with the accompanied drawings, but the present invention is not limited to the embodiments.

Embodiment 1

Figure 1:
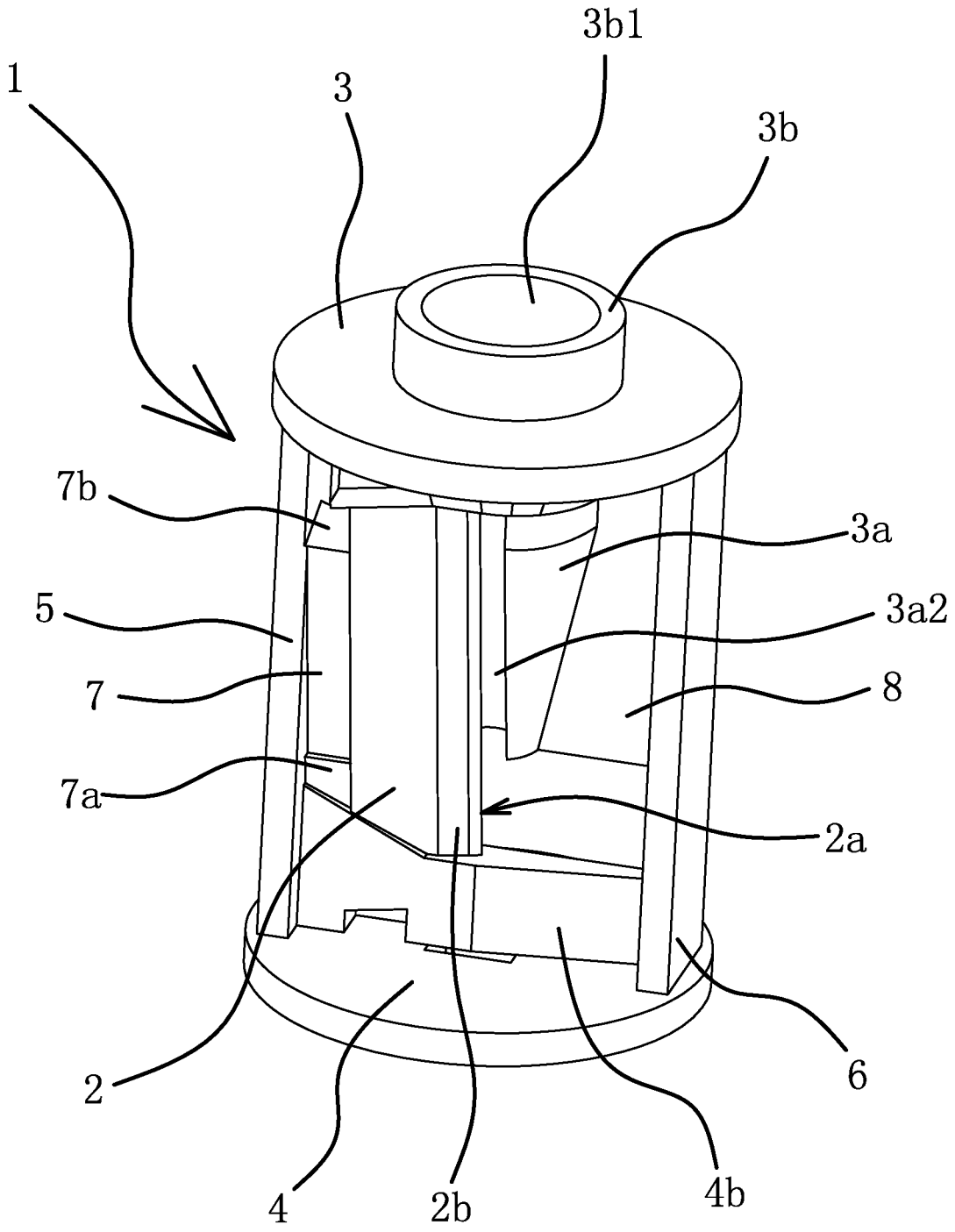
FIG. 1 is a perspective view of a first embodiment of a pencil sharpener assembly.
Figure 2:
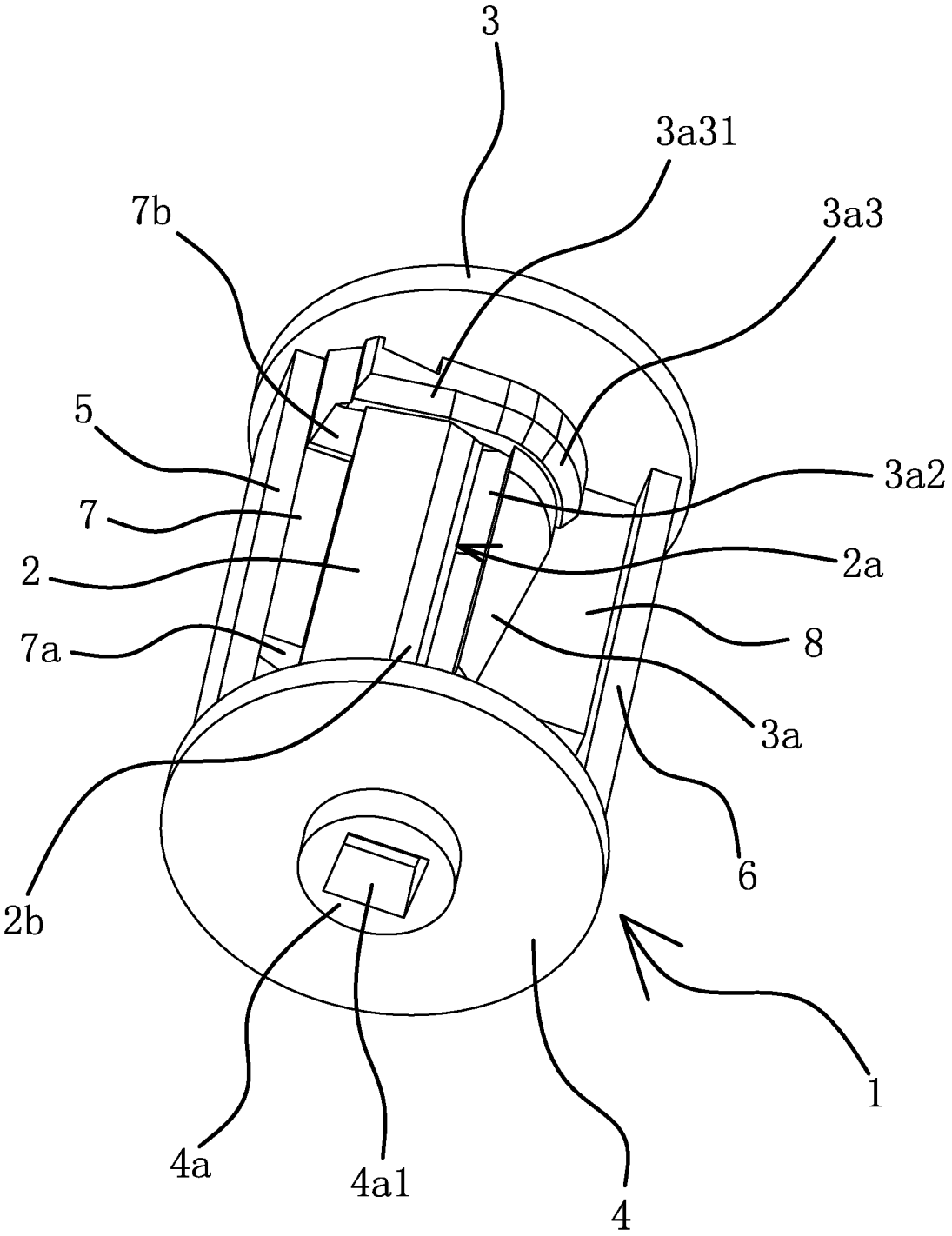
FIG. 2 is a perspective view of another angle of the first embodiment of the pencil sharpener assembly.
Figure 6:
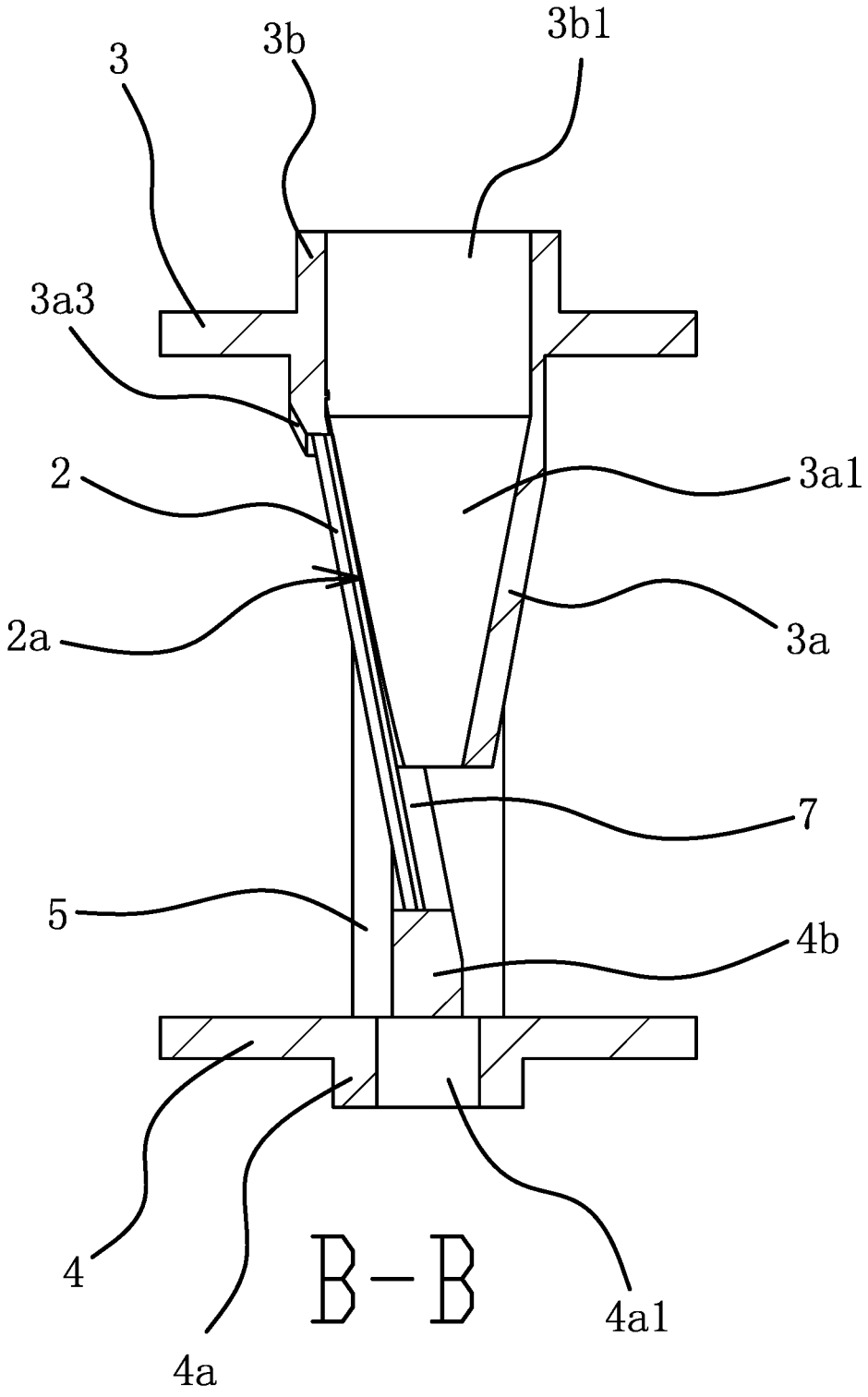
FIG. 6 is a cross-sectional view taken along line B-B of FIG. 4.
Figure 7:
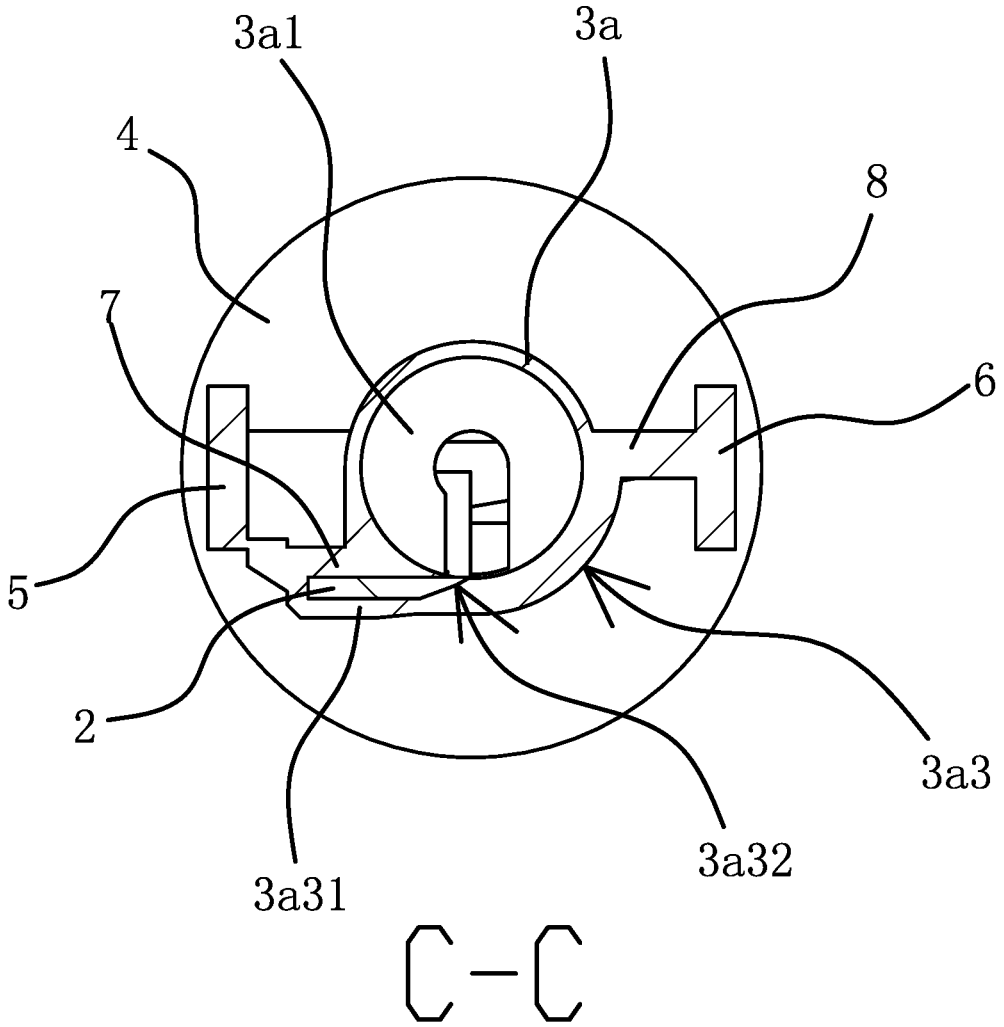
FIG. 7 is a cross-sectional view taken along line C-C of FIG. 4.
Figure 8:
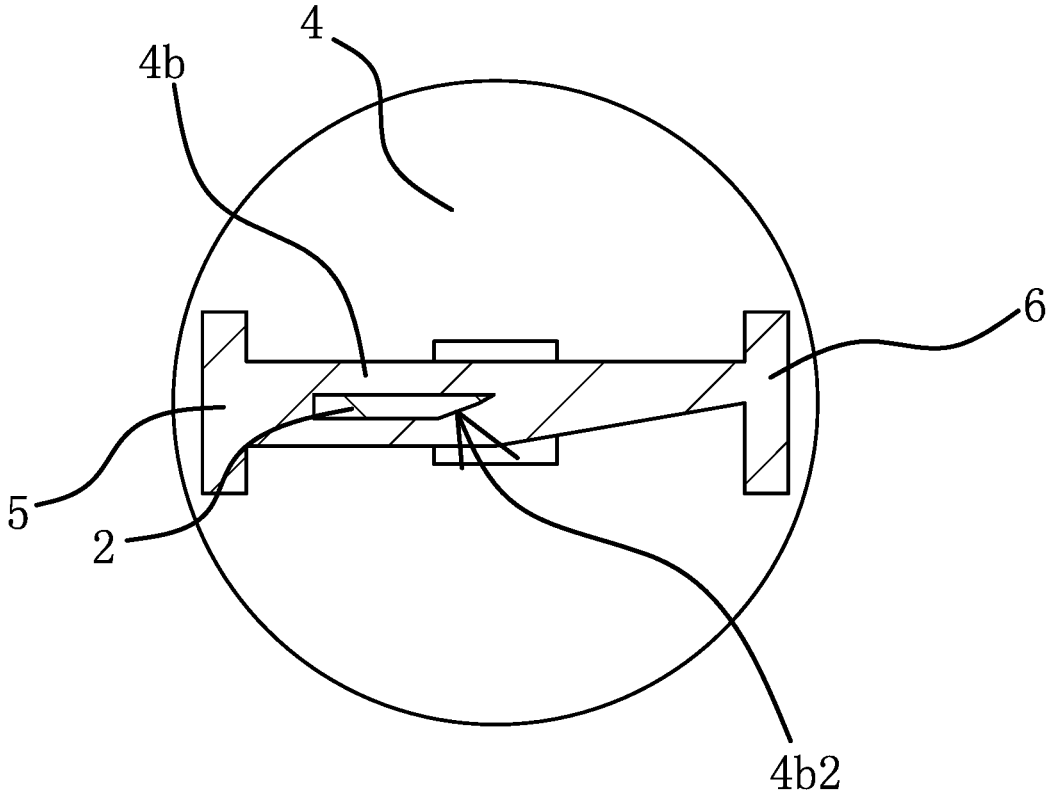
FIG. 8 is a cross-sectional view taken along line D-D of FIG. 4.

As shown in FIG. 1, FIG. 2, and FIG. 6, one embodiment of a pencil sharpener assembly comprises a frame 1 and a blade 2, the blade 2 is made of a ceramic material. The blade 2 has an elongated sheet shape, and one side of the blade 2 is disposed with a blade edge 2*a*. The frame 1 is an integrated structure, the frame 1 comprises a lower plate 4, an upper plate 3 disposed oppositely to the lower plate 4, and a first support plate 5 and a second support plate 6 which are both fixedly connected between the upper plate 3 and the lower plate 4, and the first support plate 5 and the second support plate 6 are disposed oppositely to each other. A lower end surface of the lower plate 4 is disposed with a protruded coupler 4*a*, and the coupler 4*a* is provided with a square coupling hole 4*a*1. The disposition of the coupling hole 4*a*1 is mainly provided for inserting a rotating shaft end of a motor when the pencil sharpener assembly is used in an electric pencil sharpener, so that the rotating shaft of the motor can drive the entire pencil sharpener assembly to rotate together to sharpen a pencil.

Figure 3:
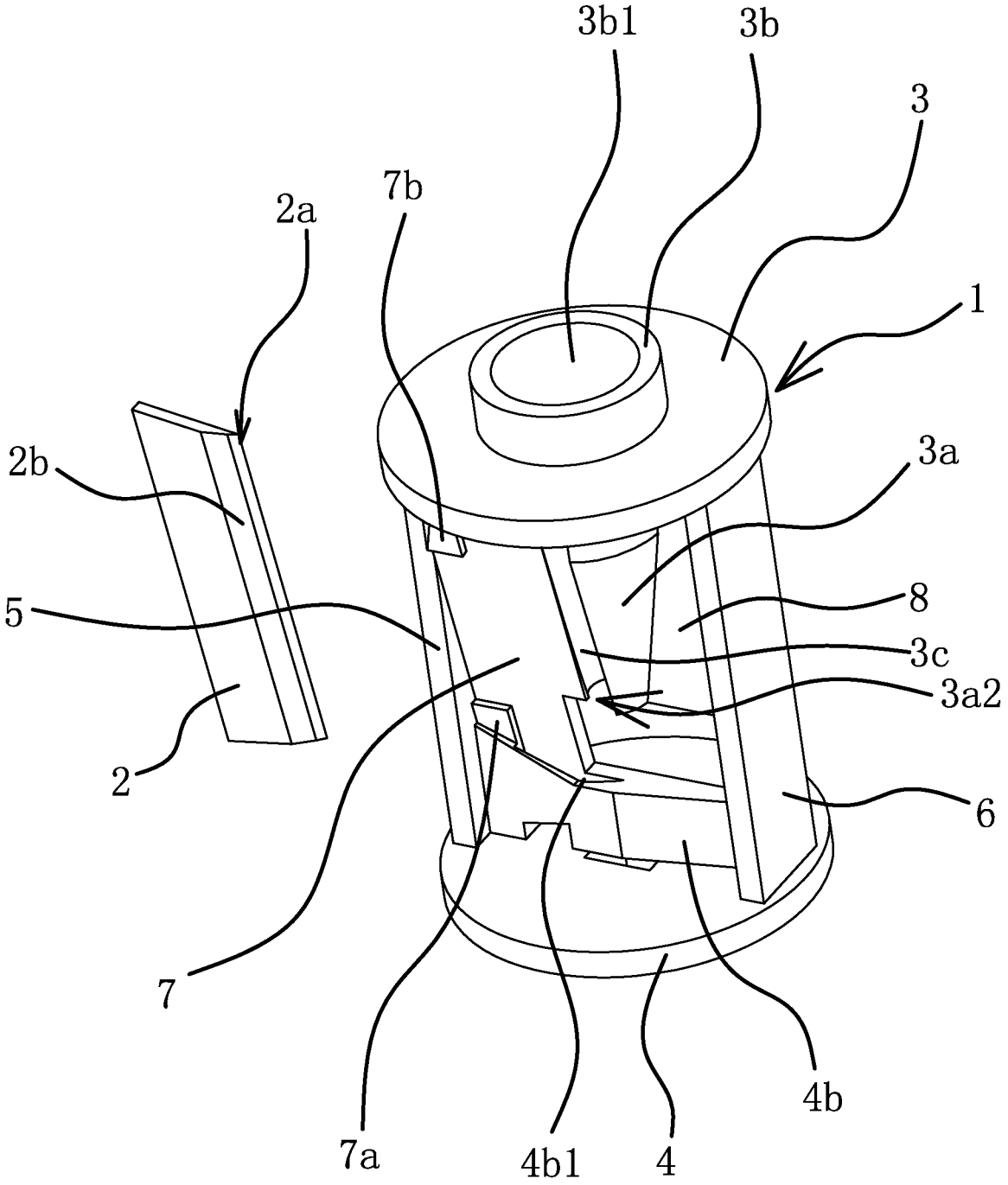
FIG. 3 is an exploded perspective view of the first embodiment of the pencil sharpener assembly.

As shown in FIG. 3 and FIG. 6, one embodiment of an upper end surface of the upper plate 3 is disposed with a protruded pencil portal 3*b*, and a pencil entry hole 3*b*1 is provided on the pencil portal 3*b*. A lower end surface of the upper plate 3 is disposed with a protruded pencil holder 3*a*, the pencil holder 3*a* has an inverted tapered shape, and the pencil holder 3*a* is penetrating disposed with a pencil chamber 3*a*1 in an axial direction of the pencil holder 3*a*. A lower end of the pencil entry hole 3*b*1 is communicated to an upper end of the pencil chamber 3*a*1. A side portion of the pencil holder 3*a* is disposed with a blade inlet 3*a*2 communicated with the pencil chamber 3*a*1, the blade 2 is disposed along an axial direction of the pencil chamber 3*a*1, and the blade edge 2*a* of the blade 2 passes through the blade inlet 3*a*2 and extends into the pencil chamber 3*a*1.

Figure 5:
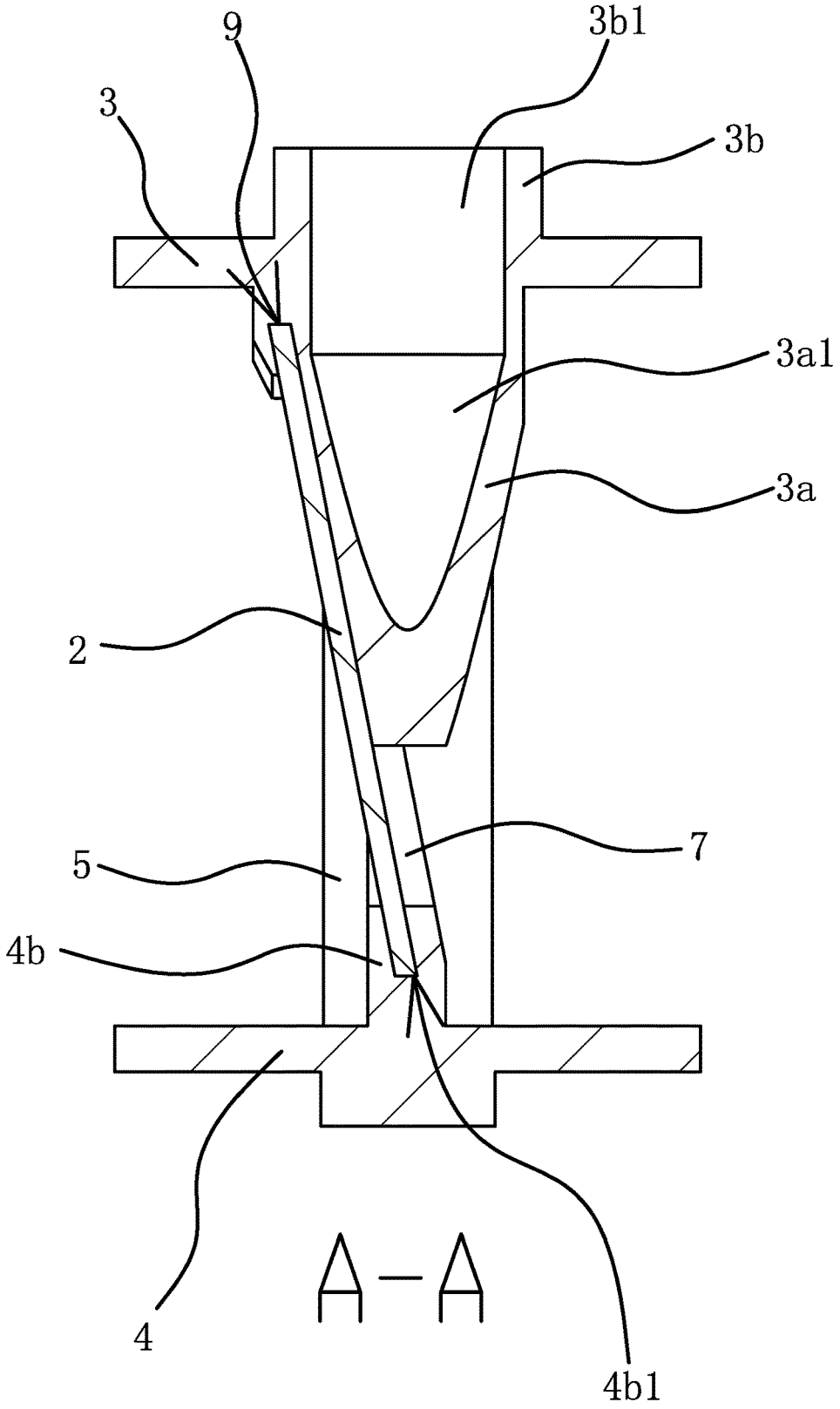
FIG. 5 is a cross-sectional view taken along line A-A of FIG. 4.

As shown in FIG. 3 and FIG. 5, one embodiment of a support panel 7 is fixedly connected between an inner side wall of the first support plate 5 and an outer side wall of the pencil holder 3*a*, the blade 2 is attached on the support panel 7, a surface of the support panel 7 that mates with the blade 2 is flush with a second side wall 3*c* of the pencil holder 3*a* at the blade inlet 3*a*2, and the blade edge 2*a* of the blade 2 passes through the blade inlet 3*a*2 and extends into the pencil chamber 3*a*1. An upper end surface of the lower plate 4 is disposed with a protruded positioning portion 4*b*, the positioning portion 4*b* is fixedly connected to both the inner side wall of the first support plate 5 and an inner side wall of the second support plate 6, and the positioning portion 4*b* is located below the pencil holder 3*a*. A lower end surface of the support panel 7 is fixedly connected to an upper end surface of the positioning portion 4*b*. A shape of the first positioning groove 4*b*1 is the same as a cross section of the blade 2, the first positioning groove 4*b*1 is disposed on the upper end surface of the positioning portion 4*b*, a first end of the blade 2 is inserted into the first positioning groove 4*b*1, and inner walls of the first positioning groove 4*b*1 mate with outer walls of the blade 2 respectively.

Figure 4:
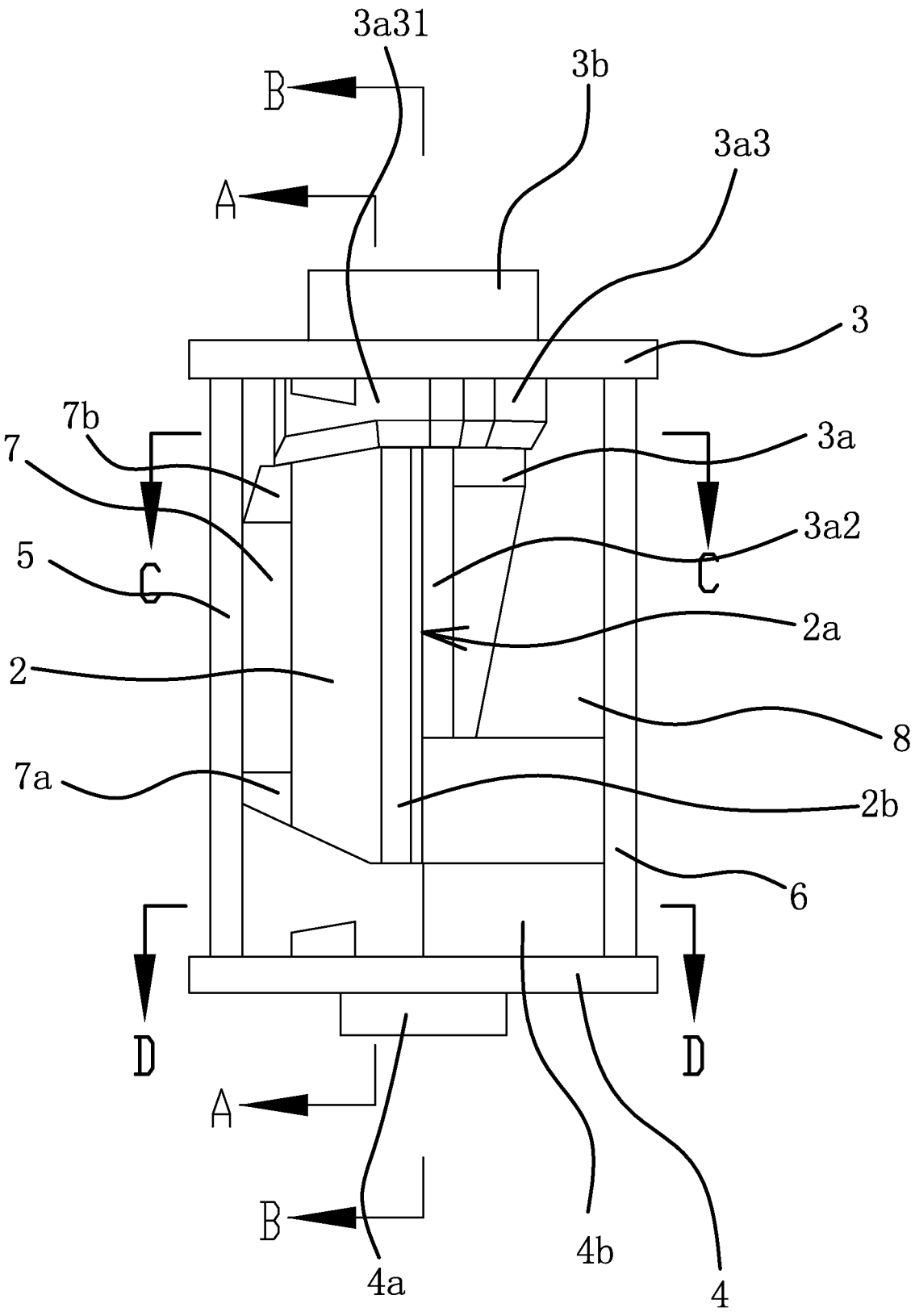
FIG. 4 is a front view of the first embodiment of the pencil sharpener assembly.
Figure 9:
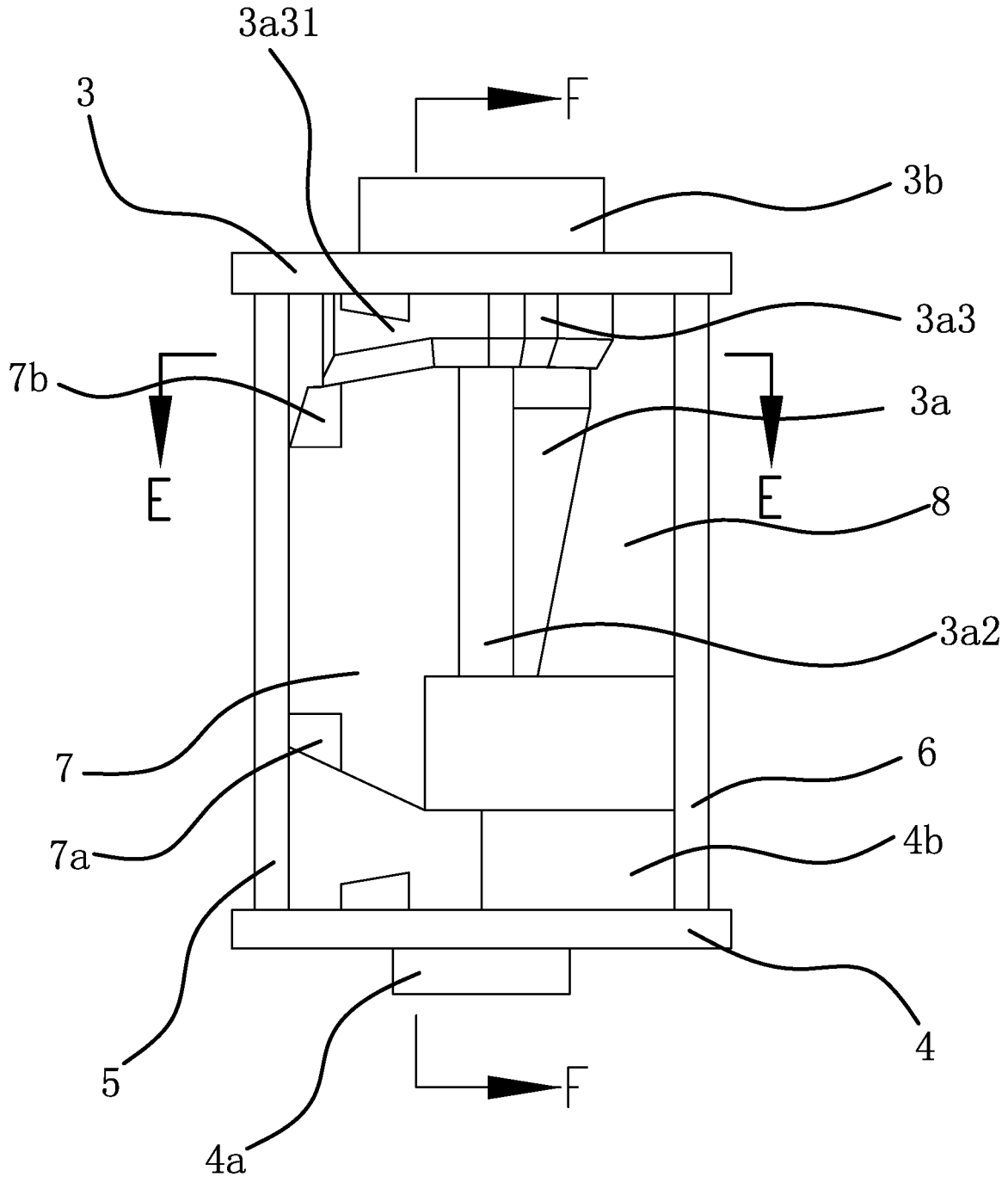
FIG. 9 is a front view of a frame of the first embodiment of the pencil sharpener assembly.
Figure 10:
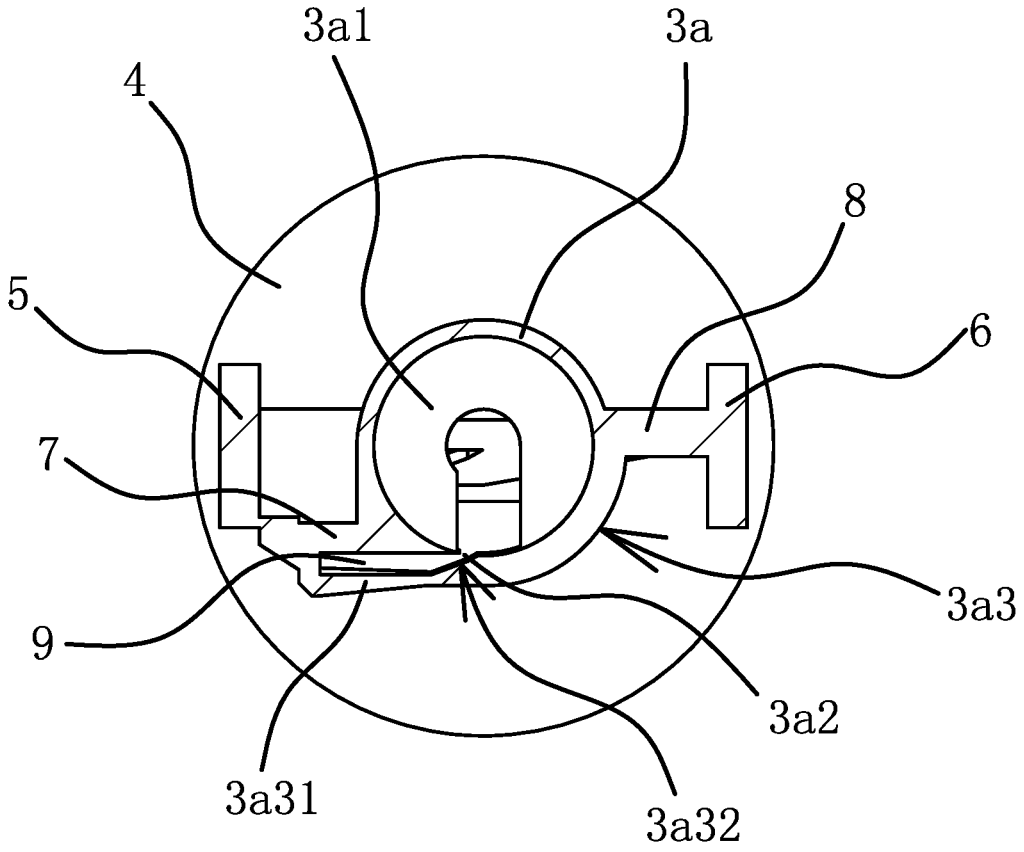
FIG. 10 is a cross-sectional view taken along line E-E of FIG. 9.
Figure 11:
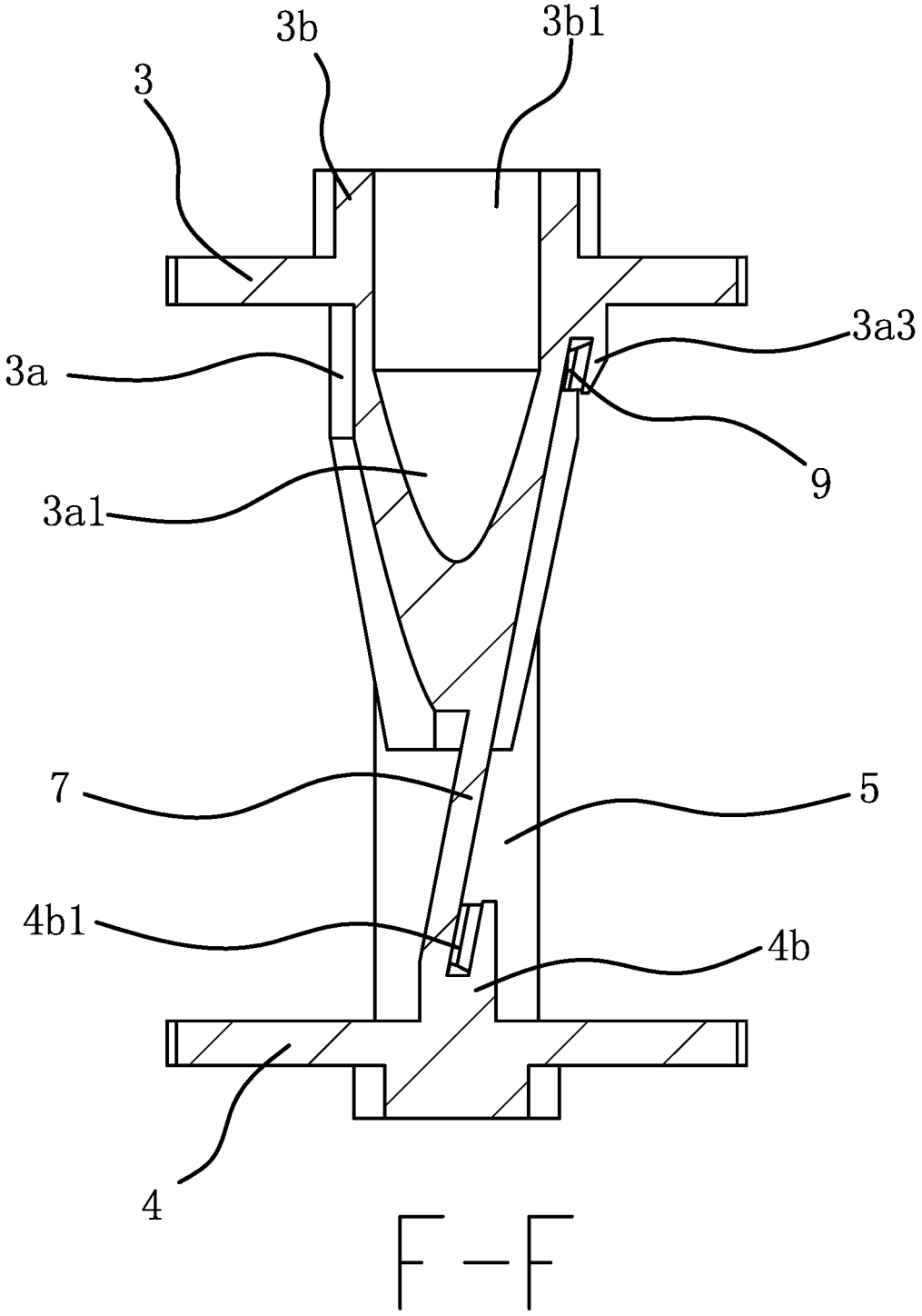
FIG. 11 is a cross-sectional view taken along line F-F of FIG. 9.

As shown in FIG. 1, FIG. 4, and FIG. 9, in one embodiment, a lower portion of the surface of the support panel 7 that mates with the blade 2 is disposed with a first positioning block 7*a*, a lower end surface of the first positioning block 7*a* is fixedly connected to the upper end surface of the positioning portion 4*b*, a first side wall of the first positioning block 7*a* is fixedly connected to the inner side wall of the first support plate 5, and a second side wall of the first positioning block 7*a* abuts against a blade spine opposite the blade edge 2*a*.

As shown in FIG. 2, FIG. 3, FIG. 4, FIG. 8, FIG. 9, and FIG. 10, one embodiment of an outer side of an upper end of the pencil holder 3*a* is disposed with an outer bulge 3*a*3 along an outer peripheral surface of the pencil holder 3*a*, the outer bulge 3*a*3 has an arcuate shape, and a first end of the outer bulge 3*a*3 is disposed with an extension 3*a*31 extended outward away from the pencil holder 3*a*. A bolster panel 8 is fixedly connected between the outer side wall of the pencil holder 3*a* and an inner side wall of the second support plate 6, an upper end surface of the bolster panel 8 is fixedly connected to the lower end surface of the upper plate 3, and a second end of the outer bulge 3*a*3 is fixedly connected to the bolster panel 8.

As shown in FIG. 5, FIG. 7, FIG. 8, FIG. 10, and FIG. 11, one embodiment of an upper end surface of the support panel 7 is fixedly connected to the lower end surface of the upper plate 3, and an upper portion of the surface of the support panel 7 that mates with the blade 2 as well as an inner side surface of the extension 3*a*31 form a second positioning groove 9. The second positioning groove 9 and the first positioning groove 4*b*1 are oppositely disposed, a second end of the blade 2 is inserted into the second positioning groove 9, a shape of the second positioning groove 9 is the same as the cross section of the blade 2, and inner walls of the second positioning groove 9 mate with the outer walls of the blade 2 respectively. The second positioning groove 9 communicates with the blade inlet 3*a*2, the blade 2 is disposed with a bevel 2*b* adjacent to the blade edge 2*a*. An inner side of the outer bulge 3*a*3 is correspondingly disposed with an inclined second locking surface 3*a*32, and the second locking surface 3*a*32 is attached to an upper portion of the bevel 2*b*. The positioning portion 4*b* is correspondingly disposed with an inclined first locking surface 4b2 on an inner side of the first positioning groove 4b1, and the first locking surface 4b2 is attached to a lower portion of the bevel 2b.

As shown in FIG. 1, FIG. 2, FIG. 4, and FIG. 8, in one embodiment, the upper portion of the surface of the support panel 7 that mates with the blade 2 is disposed with a second positioning block 7b, an upper end surface of the second positioning block 7b is fixedly connected to a lower end surface of the outer bulge 3a3, and a first side wall of the second positioning block 7b abuts against the blade spine opposite the blade edge 2a.

One embodiment of the pencil sharpener assembly is provided with the first positioning groove 4b1 and the second positioning groove 9 disposed oppositely on the frame 1, and by having the first end of the ceramic-made blade 2 inserted into the first positioning groove 4b1, and the second end inserted into the second positioning groove 9, thereby the ceramic-made blade 2 can be fixed on the frame 1. Therefore, the technical problem that the ceramic-made blade 2 cannot be fixed on the frame 1 by screws like the conventional blade due to its high degree of brittleness is solved, thereby realizing the use of the ceramic-made blade 2 in the field of pencil sharpener.

At the same time, one embodiment of the blade 2 is easily subjected to a backward reacting force when sharpening the pencil. Therefore, although the two ends of the blade are fixed on the frame 1 by the first positioning groove 4b1 and the second positioning groove 9, the portion of the blade 2 other than the two ends becomes more brittle. Therefore, by making the lower portion of the surface of the support panel 7, which mates with the blade 2, disposed with the first positioning block 7a; and by making the upper portion of the surface of the support panel 7, which mates with the blade 2, disposed with the second positioning block 7b; and by having the second side wall of the first positioning block 7a as well as the first side wall of the second positioning block 7b abutted against the blade spine opposite the blade edge 2a; a good supporting force can be formed when the blade 2 is subjected to a backward reacting force, so that the ceramic-made blade 2 can be well fixed during use. Moreover, the first end of the ceramic-made blade 2 is fixed by the first positioning groove 4b1, and the second end of the ceramic-made blade 2 is fixed by the second positioning groove 9, so that it is not required to process on the ceramic-made blade 2, thereby preventing the ceramic-made blade 2 from fracturing when it is being fixed.

In addition, the blade edge 2a of the blade 2 in the conventional design is also required to pass through the blade inlet 3a2 and extend into the pencil chamber 3a1; however, since the ordinary blade can be directly fixed by screws, the case in which the blade edge 2a of the blade 2 extends excessively into the pencil chamber 3a1 will not occur. However, since the pencil sharpener assembly in the present application adopts the ceramic-made blade 2 and uses the first positioning groove 4b1 and the second positioning groove 9 to position the both ends of the ceramic-made blade 2, it is impossible to control an extent to which the blade edge 2a of the blade 2 extends into the pencil chamber 3a1. In order to solve this problem, by having the blade 2 of the pencil sharpener assembly disposed with the bevel 2b adjacent to the blade edge 2a, the inner side of the outer bulge 3a3 correspondingly disposed with the inclined second locking surface 3a32, and by having the second locking surface 3a32 attached on the bevel 2b, so that the extent to which the blade edge 2a of the blade 2 extends into the pencil chamber 3a1 is limited. Thereby the extent to which the blade edge 2a of the blade 2 extends into the pencil chamber 3a1 can be well ensured after the ceramic-made blade 2 is fixed on the frame 1, and the fixing effect of the ceramic-made blade 2 on the frame 1 can be further enhanced.

One embodiment of the frame 1 can be made of plastic or aluminum alloy. Using the frame 1 made of plastic as an example, the pencil sharpener assembly can have the ceramic-made blade 2 directly integrated into the frame 1 when the frame 1 is formed by injection molding, and specifically, the blade 2 can be placed in a mold of the frame 1 with a cavity having a same shape as the frame 1, and then injection mold the mold of the frame 1. In this way, after the frame 1 is formed in the mold of the frame 1, the first positioning groove 4b1 and the second positioning groove 9 are formed on the frame 1, and at the same time, the first end of the blade 2 is naturally located in the first positioning groove 4b1, and the second end of the blade 2 is naturally located in the second positioning groove 9, thereby enabling the ceramic-made blade 2 to be fixed on the frame 1 to realize the use of the ceramic-made blade 2 in the field of pencil sharpener. If the frame 1 is made of an aluminum alloy, the blade 2 can be placed in the cavity of the mold of the frame 1 when the frame 1 is formed, and then the frame 1 can be formed by die casting and the ceramic-made blade 2 can be encapsulated. A length of one side of the blade 2 provided with the blade edge 2a is smaller than a length of the opposite spine side of the blade 2. By such disposition, the two ends of the blade 2 can be inclined, and the two ends of the blade 2 are inclined to match the inclined surfaces in the mold, thereby preventing the blade edge 2a of the blade 2 from displacing and touching the inner walls of the mold.

Embodiment 2

Figure 12:
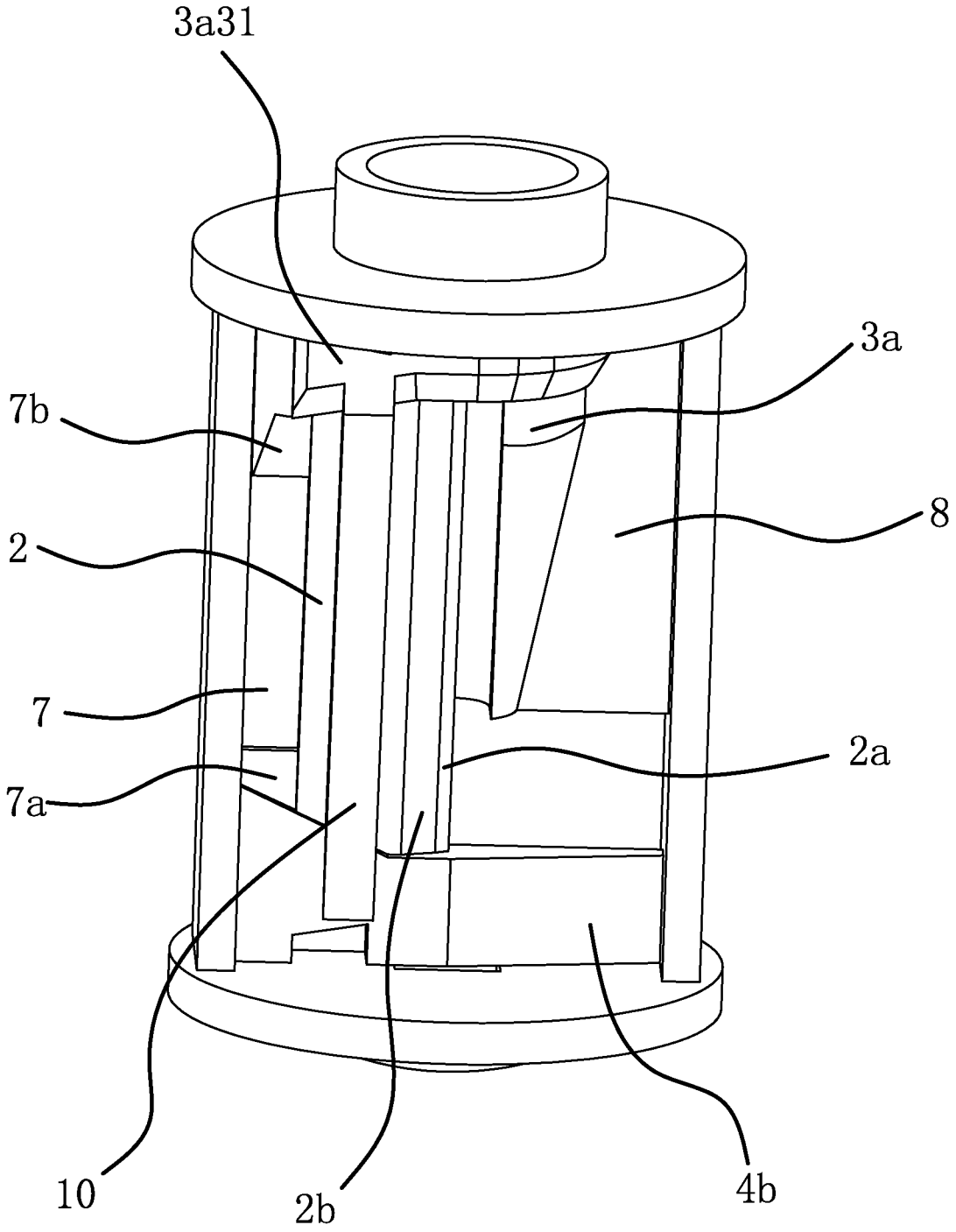
FIG. 12 is a schematic view of a second embodiment of the pencil sharpener assembly.

The structure and the principles of this embodiment are basically the same as those of the first embodiment. The differences lie in that, as shown in FIG. 12, in this embodiment, a bolster strip 10 is disposed between an outer side wall of the outer bulge 3a3 and an outer side wall of the positioning portion 4b, and an inner side surface of the bolster strip 10 is attached to an outer side surface of the blade 2. By having the bolster strip 10 disposed between the outer side wall of the outer bulge 3a3 and the outer side wall of the positioning portion 4b, and the inner side surface of the bolster strip 10 attached to the outer side surface of the blade 2, the fixing effect of the ceramic-made blade 2 on the frame 1 can be further enhanced.

The specific embodiments described herein are merely illustrative of the spirit of the present invention. Technical personnel skilled in the art to which the present invention pertains can make various modifications or additions to the specific embodiments described or replace them in a similar manner, without departing from the spirit of the present invention or beyond the scope defined by the appended claims.

List of Referenced Parts

1 frame
2 blade
2a blade edge
2b bevel
3 upper plate
3a pencil holder
3a1 pencil chamber
3a2 blade inlet
3a3 outer bulge

3*a*31 extension
3*a*32 second locking surface
3*b* pencil portal
3*b*1 pencil entry hole
3*c* second side wall
4 lower plate
4*a* coupler
4*a*1 coupling hole
4*b* positioning portion
4*b*1 first positioning groove
4*b*2 first locking surface
5 first support plate
6 second support plate
7 support panel
7*a* first positioning block
7*b* second positioning block
8 bolster panel
9 second positioning groove
10 bolster strip

What is claimed is:

1. A pencil sharpener assembly comprising:

a frame with an inner chamber, the frame disposed with a first positioning groove and a second positioning groove;

an elongated sheet shape blade with a blade edge, the blade being on a conical surface of the inner chamber;

the frame comprises a first support plate; and a pencil holder, the inner chamber disposed on the pencil holder and a side portion of the pencil holder penetratingly disposed with a blade inlet communicated with the inner chamber;

wherein the blade is made of a ceramic material;

wherein the first positioning groove and the second positioning groove are oppositely disposed, a first end of the blade is inserted into the first positioning groove, and a second end of the blade is inserted into the second positioning groove;

wherein the frame comprises a positioning portion located below the pencil holder; and wherein a support panel is fixedly connected between an inner side wall of the first support plate and an outer side wall of the pencil holder, a lower end surface of the support panel is fixedly connected to an upper end surface of the positioning portion, an upper end surface of the support panel is fixedly connected to the lower end surface of the upper plate, an outer side of an upper end of the pencil holder is disposed with an outer bulge along an outer peripheral surface of the pencil holder, the outer bulge has an arcuate shape, a first end of the outer bulge is disposed with an extension extended outward away from the pencil holder, and the second positioning groove is formed by an upper portion of a surface of the support panel that mates with the blade and by an inner side surface of the extension.

2. The pencil sharpener assembly as claimed in claim 1, wherein the frame further comprises an upper plate, a lower plate disposed oppositely to the upper plate, and a second support plate disposed oppositely to the first support plate, the first support plate and the second support plate are respectively connected between the upper plate and the lower plate, the pencil holder is located at a lower end surface of the upper plate, the positioning portion is on an upper end surface of the lower plate, and the first positioning groove is disposed on the upper end surface of the positioning portion.

3. The pencil sharpener assembly as claimed in claim 2, wherein a lower portion of the surface of the support panel that mates with the blade is disposed with a first positioning block, a lower end surface of the first positioning block is fixedly connected to the upper end surface of the positioning portion, a first side wall of the first positioning block is fixedly connected to the inner side wall of the first support plate, and a second side wall of the first positioning block abuts against a blade spine opposite the blade edge.

4. The pencil sharpener assembly as claimed in claim 2, wherein the pencil holder has an inverted tapered shape, the blade is attached on the support panel and the surface of the support panel that mates with the blade is flush with a second side wall of the pencil holder at the blade inlet, and the blade edge of the blade passes through the blade inlet and extends into the inner chamber.

5. The pencil sharpener assembly as claimed in claim 4, wherein a bolster panel is fixedly connected between the outer side wall of the pencil holder and an inner side wall of the second support plate, an upper end surface of the bolster panel is fixedly connected to the lower end surface of the upper plate, and a second end of the outer bulge is fixedly connected to the bolster panel.

6. The pencil sharpener assembly as claimed in claim 5, wherein the upper portion of the surface of the support panel that mates with the blade is disposed with a second positioning block, an upper end surface of the second positioning block is fixedly connected to a lower end surface of the outer bulge, and a first side wall of the second positioning block abuts against the blade spine opposite the blade edge.

7. The pencil sharpener assembly as claimed in claim 4, wherein a shape of the first positioning groove and a shape of the second positioning groove are same as a cross section of the blade, each of inner walls of the first positioning groove mates with each of outer walls of a corresponding end of the blade, and each of inner walls of the second positioning groove mates with each of the outer walls of the corresponding end of the blade.

8. The pencil sharpener assembly as claimed in claim 7, wherein the second positioning groove communicates with the blade inlet, the blade is disposed with a bevel adjacent to the blade edge, an inner side of the outer bulge is correspondingly disposed with an inclined second locking surface, the positioning portion is correspondingly disposed with an inclined first locking surface on an inner side of the first positioning groove, the first locking surface is attached to a lower portion of the bevel, and the second locking surface is attached to an upper portion of the bevel.

9. The pencil sharpener assembly as claimed in claim 4, wherein a bolster strip is disposed between an outer side wall of the outer bulge and an outer side wall of the positioning portion, and an inner side surface of the bolster strip is attached to an outer side surface of the blade.

* * * * *